US006026757A

United States Patent [19]

Valle et al.

[11] Patent Number: 6,026,757

[45] Date of Patent: Feb. 22, 2000

[54] CONVEYOR FOR SEWING MACHINES FOR CLOSING THE TIP OF HOSES

[75] Inventors: Mario Valle, Pavia; Renato Pandolfi, Gorle, both of Italy

[73] Assignee: Conti Complett S.p.A., Milan, Italy

[21] Appl. No.: 09/088,875

[22] Filed: Jun. 2, 1998

[30] Foreign Application Priority Data

Jul. 2, 1997 [IT] Italy ..... MI97A01570

[51] Int. Cl.[7] ..... D05B 21/00

[52] U.S. Cl. ..... 112/470.15; 223/77

[58] Field of Search ..... 112/470.15, 470.18, 112/470.33, 470.08, 475.12; 223/75, 77

[56] References Cited

U.S. PATENT DOCUMENTS

| | | | |
|---|---|---|---|
| 2,883,093 | 4/1959 | Autem | 223/77 |
| 3,859,938 | 1/1975 | Fukuyama | 112/470.15 |
| 5,398,626 | 3/1995 | Rosso et al. | 112/470.15 |
| 5,402,733 | 4/1995 | Humphreys | 112/470.15 |
| 5,415,330 | 5/1995 | Rosso | 223/77 |
| 5,669,321 | 9/1997 | Migliorini | 112/470.15 X |
| 5,706,748 | 1/1998 | Migliorini | 112/470.15 |

FOREIGN PATENT DOCUMENTS 0555502 8/1993 European Pat. Off. .

*Primary Examiner*—Ismael Izaguirre
*Attorney, Agent, or Firm*—Guido Modiano; Albert Josif

[57] ABSTRACT

A conveyor for sewing machines for closing the tip of hoses or the like, having high-versatility use. The conveyor comprises a pair of substantially coplanar flat strips which are laterally adjacent to each other and have, on their mutually facing sides, a pair of protruding ridges which laterally delimit a passage for a portion of the hose, proximate to the tip, which is knitted with a reduced thickness with respect to the contiguous regions. Each ridge has, along the advancement direction of the hose along the passage, an initial portion and a final portion which are substantially parallel, are mutually spaced and are joined by an inclined intermediate portion. An element for advancing the hose along the passage are provided above the flat strips at the passage. Above each one of the ridges, starting from a region of their initial portion, there is a lamina which can move towards or away from the corresponding ridge and forms a resting surface for the upper border of the thinner portion of the hose.

18 Claims, 4 Drawing Sheets

CONVEYOR FOR SEWING MACHINES FOR CLOSING THE TIP OF HOSES

BACKGROUND OF THE INVENTION

The present invention relates to a conveyor for sewing machines for closing the tip of hoses or the like, having high-versatility use.

It is known that hoses are generally produced with an open tip and are then subjected to a stitching or looping operation for closing the tip.

Sewing machines for performing this operation are generally constituted by a sewing unit which is fed with the hoses by means of an adapted conveyor. The conveyor is usually constituted by a pair of flat strips which are substantially co-planar, are arranged side by side and have, on their mutually facing sides, two protruding ridges which laterally delimit a passage for a portion of the hose proximate to the tip.

The conveyor is meant to arrange the hoses correctly with respect to the sewing unit, so as to achieve fully satisfactory tip closure.

Through the years, particular refinements have been devised to achieve an increasingly accurate sewing of the tip of hoses which can be compared, in terms of quality, to tip closure formed by looping.

One of these refinements consists in performing, at the end of the knitting of the hose, i.e., at the tip which remains open, a few additional rows with a particularly fine thread, such as helanca, and then some further rows with a thicker thread so as to obtain, at the end of the knitting process, a border which is thicker than the additional helanca rows.

In practice, at the end of the knitting of the hose, proximate to the tip of the hose there is a thinner portion which lies between the final border and the remaining part of the hose, both of which are thicker. This thinner portion is used to correctly position the hose, during its advancement along the conveyor, with respect to the sewing unit.

The ridges that protrude on the mutually facing sides of the two flat strips have an initial portion and a final portion which are substantially parallel and are mutually spaced in the direction of the thickness of the two flat strips. The initial portion and the final portion are joined by an inclined intermediate portion. Furthermore, above the pair of flat strips there are advancement means which engage the portion of the hose that protrudes upwards from the two flat strips so as to convey the hose along the flat strips toward the sewing unit.

In practice, the hose is inserted, with its thinner portion, between the two ridges of the two flat strips that delimit said passage, so that the final border of the hose protrudes upwards from the flat strips to be gripped by the advancement means and so that the remaining part of the hose is arranged below the ridges.

In this manner, during the advancement of the hose along the passage formed between the two flat strips, the lower border of the thinner portion of the hose, i.e., the beginning of the actual hose, is pulled, due to the combined action of the advancement means and of the intermediate inclined portion, against the lower side of the two ridges and is thus positioned correctly with respect to the sewing unit.

Despite these refinements, in some cases the tip closure performed with sewing machines of this kind can turn out to be scarcely accurate.

Particularly in its initial region, the thicker border that protrudes above the two flat strips and is meant to be taken up by the advancement means can in fact be stretched downwards toward the flat strips, causing the advancement means to grip it imperfectly and thus causing a less than satisfactory arrangement of the hose with respect to the two flat strips.

Furthermore, depending on the machines used for production and on the type of hose, it is possible to have mutually different heights for the thinner portions of the hose.

Owing to this fact, in order to achieve correct arrangement of the hoses upstream of the sewing unit it is necessary to use flat strips of different thicknesses which correspond to the different heights of the thinner portion of the hose.

The need to replace the flat strips according to the height of the thinner portion of the hoses is a problem both in terms of costs, since it is necessary to provide a plurality of flat strips, and in terms of machine productivity, since replacing the flat strips necessarily entails stopping the production of the machine.

SUMMARY OF THE INVENTION

The aim of the present invention is to solve the above problems by providing a conveyor for sewing machines for closing the tip of hoses or the like which is capable of correctly positioning hoses or the like having a portion, proximate to the tip, which is knitted with a reduced thickness and has a variable height, without entailing the need to replace the flat strips.

Within the scope of this aim, an object of the invention is to provide a conveyor which adequately supports the expanded border, arranged at the end of the hose that must be sewn, while it is being gripped by the advancement means of the conveyor, so as to make the action of the advancement means on the hose particularly effective and precise.

Another object of the invention is to provide a conveyor which can be installed without problems in conventional kinds of sewing machine for closing the tip of hoses or the like.

This aim, these objects and others which will become apparent hereinafter are achieved by a conveyor for sewing machines for closing the tip of hoses or the like, comprising a pair of substantially co-planar flat strips which are laterally adjacent to each other and have, on their mutually facing sides, a pair of protruding ridges which laterally delimit a passage for a portion of the hose, proximate to the tip, which is knitted with a reduced thickness with respect to the contiguous regions; each one of said ridges having, along the advancement direction of the hose along said passage, an initial portion and a final portion which are substantially parallel, are mutually spaced and are joined by an inclined intermediate portion, means for advancing the hose along said passage being provided above said flat strips at said passage;

characterized in that above each one of said ridges, starting from a region of said initial portion, there is a lamina which can move towards or away from the corresponding ridge and forms a resting surface for the upper border of said thinner portion of the hose.

BRIEF DESCRIPTION OF THE DRAWINGS

Further characteristics and advantages of the invention will become apparent from the description of a preferred but not exclusive embodiment of the conveyor according to the invention, illustrated only by way of non-limitative example in the accompanying drawings, wherein.

DESCRIPTION OF THE PREFERRED EMBODIMENTS

Figure 1:
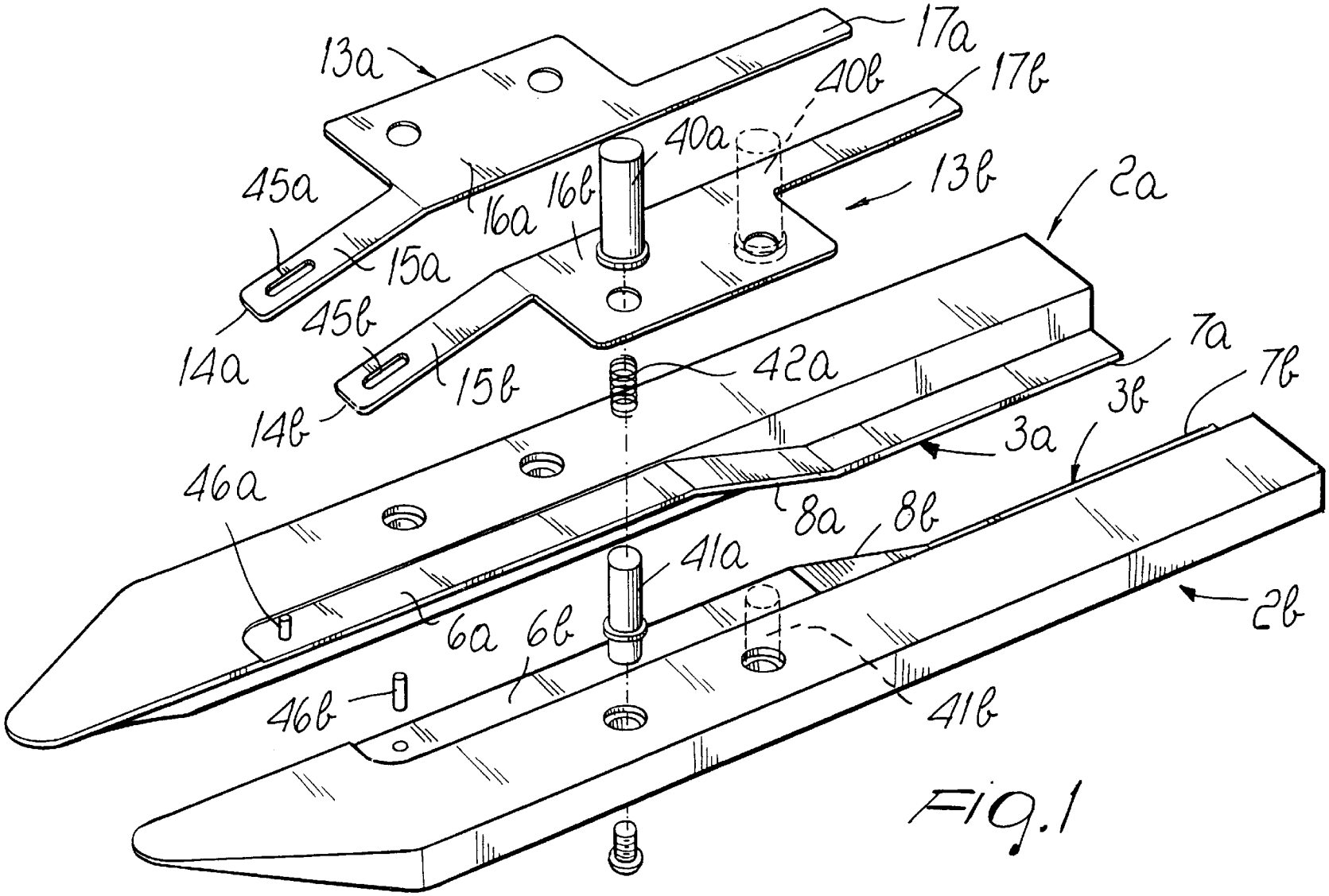
FIG. 1 is an exploded perspective view of the two flat strips, with the corresponding laminae of the conveyor according to the invention.
Figure 2:
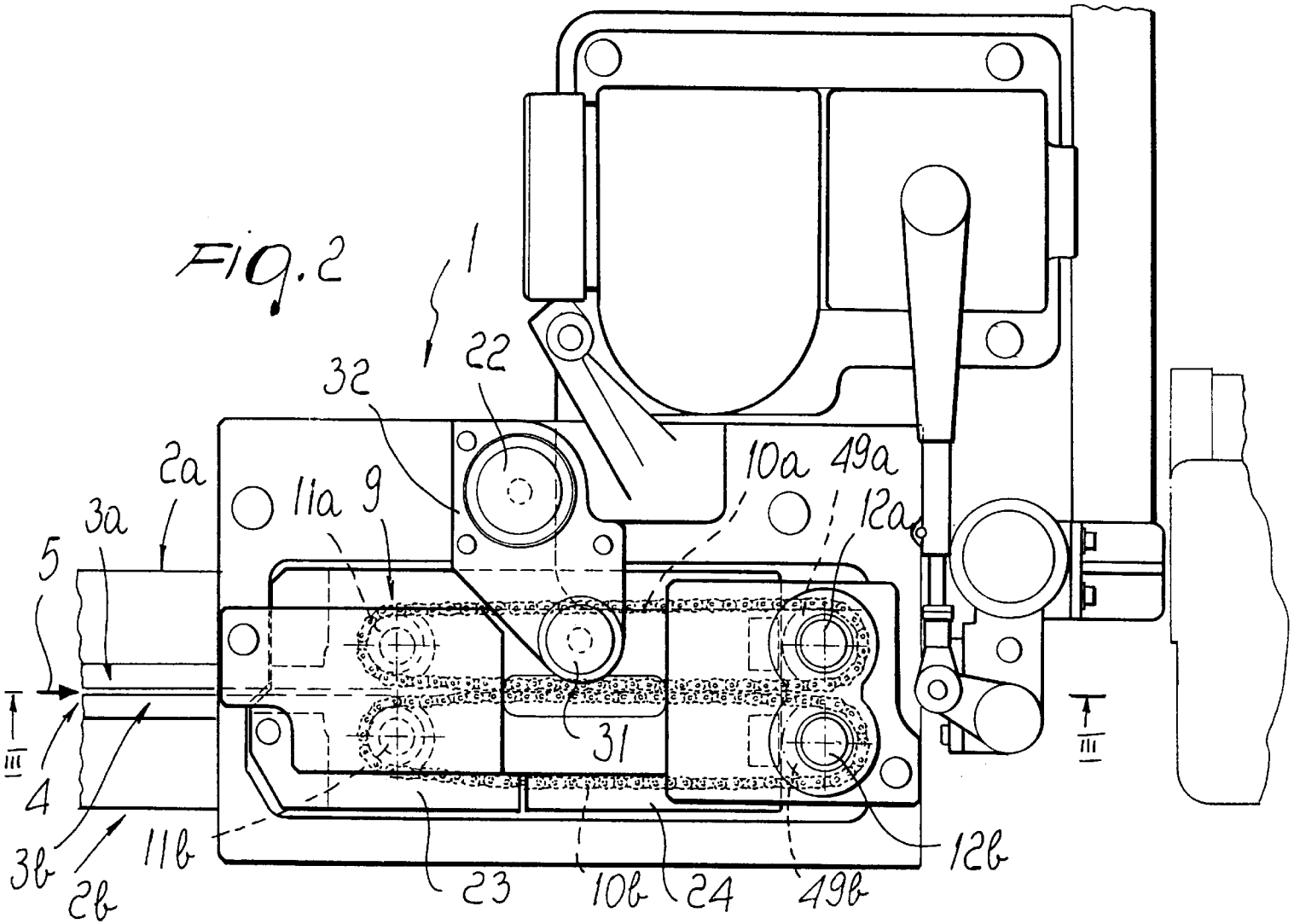
FIG. 2 is a schematic top plan view of the conveyor according to the invention.
Figure 3:
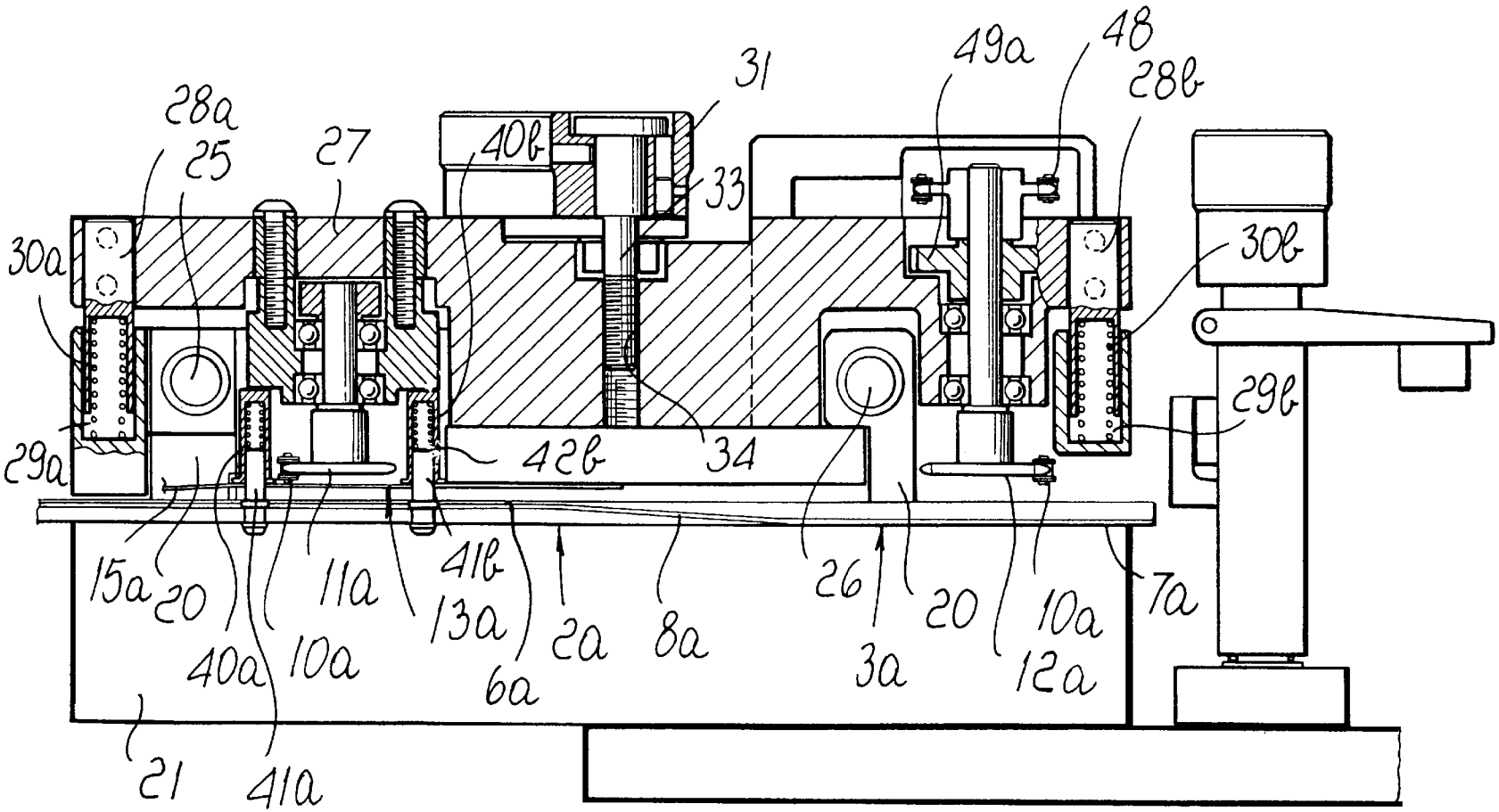
FIG. 3 is a schematic sectional view of FIG. 2, taken along the plane III—III.
Figure 4:
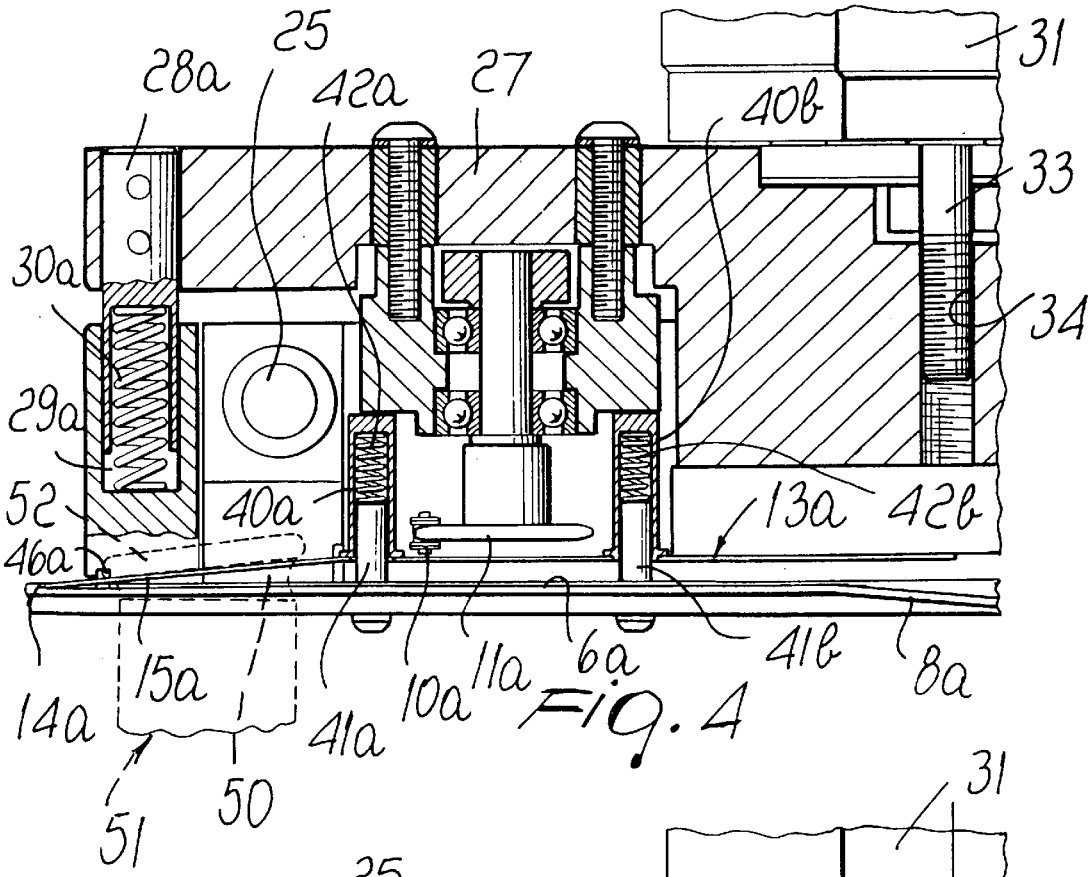
FIGS. 4 and 5 are enlarged-scale views of a detail of FIG. 3, illustrating the possibility to adjust the distance between the lamina and the ridge of the corresponding flat strip.
Figure 5:
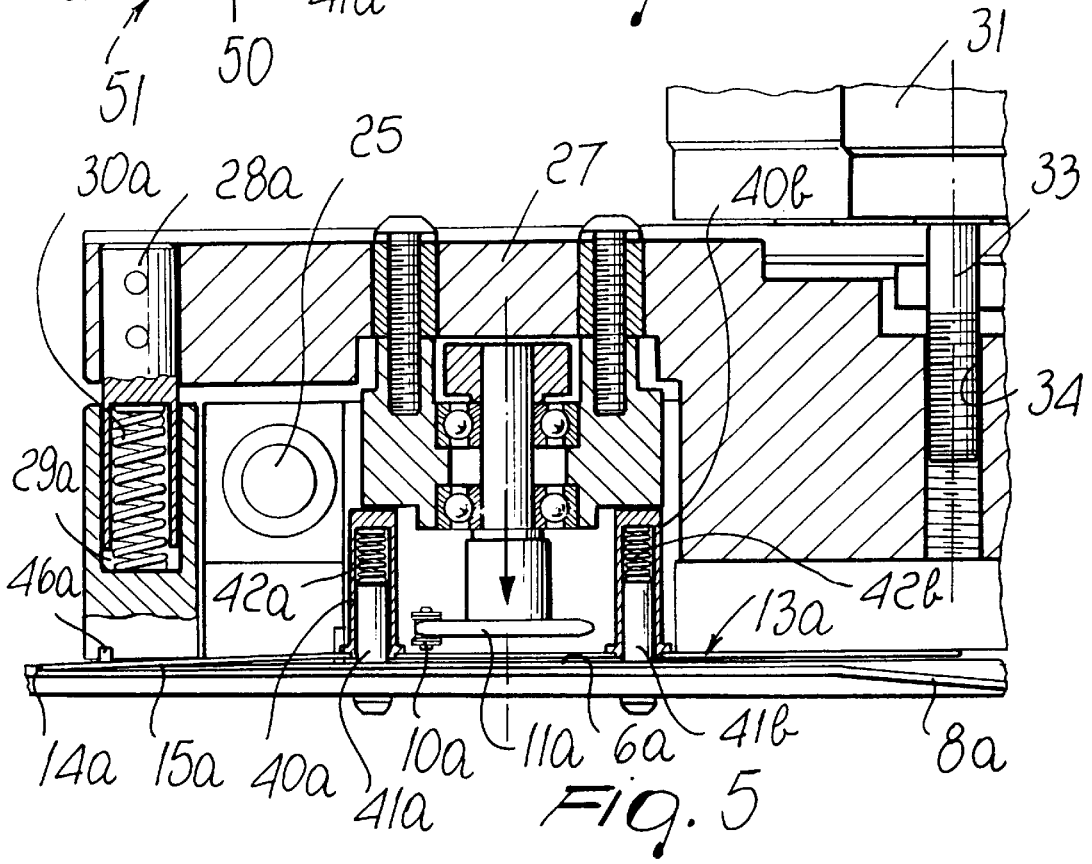

With reference to the above figures, the conveyor according to the invention, generally designated by the reference numeral 1, comprises a pair of flat strips 2*a* and 2*b* which are substantially co-planar, preferably horizontal, are laterally mutually adjacent and have, on their mutually facing sides, two protruding ridges 3*a* and 3*b* which laterally delimit a passage 4 for a portion 50 of the hose 51, proximate to the tip, which is knitted with a reduced thickness with respect to the contiguous regions.

The ridges 3*a* and 3*b* have, in the direction in which the hose 51 advances along the passage 4, indicated by the arrow 5 in the figures, an initial portion 6*a* and 6*b*, which is parallel to the plane of arrangement of the flat strips 2*a* and 2*b*, and a final portion 7*a* and 7*b*, which also is parallel to the plane of arrangement of the flat strips 2*a* and 2*b* but spaced downwards with respect to the portion 6*a* and 6*b*. The initial portion 6*a* and 6*b* is connected to the final portion 7*a* and 7*b* by means of an intermediate portion 8*a* and 8*b* which is inclined downwards.

Above the flat strips 2*a* and 2*b* there are means for advancing the hose 51 which are generally designated by the reference numeral 9.

Said advancement means 9 are preferably constituted by a pair of chains 10*a* and 10*b* which wind around sprockets 11*a*, 11*b*, 12*a* and 12*b*, the axes whereof are substantially perpendicular to the plane of arrangement of the flat strips 2*a* and 2*b* so that the two chains 10*a* and 10*b* have two mutually facing portions at the passage 4 in order to engage the border 52 that delimits, in an upward region, the thinner portion 50 of the hose 51.

According to the invention, above each one of the ridges 3*a* and 3*b*, starting from a region of the initial portion 6*a* and 6*b*, there is a lamina 13*a* and 13*b* which can move towards or away from the corresponding ridge 3*a* and 3*b* and forms a resting surface for the upper border 52 of the thinner portion 50 of the hose 51.

More particularly, each lamina 13*a* and 13*b* is constituted by a lamina which can flex elastically towards or away from the corresponding ridge 3*a* and 3*b*.

Each lamina 13*a* and 13*b* rests by means of its initial end 14*a* and 14*b*, i.e., by means of the end directed toward the end of the flat strips 2*a* and 2*b* through which the hose 51 is inserted, and has a first initial portion 15*a* and 15*b* which is inclined upwards starting from the upper face of the initial portion 6*a* and 6*b* of the corresponding ridge 3*a* and 3*b*.

After the initial portion 15*a* and 15*b*, each lamina 13*a* and 13*b* has a second portion 16*a* and 16*b* which is substantially parallel to the initial portion 6*a* and 6*b* of the corresponding ridge 3*a* and 3*b*.

The region where the advancement means 9 act, i.e., the region at which the chains 10*a* and 10*b* engage the border 52 of the hose 51, begins at the second portion 16*a* and 16*b* of the laminae 3*a* and 3*b*.

Advantageously, each lamina 13*a* and 13*b* has, downstream of the second portion 16*a* and 16*b* along the advancement direction 5 of the hose 51 along the passage 4, a third portion 17*a* and 17*b* or tail which lies above the intermediate portion 8*a* and 8*b* and optionally also lies above the second portion 7*a* and 7*b* of the corresponding ridge 3*a* and 3*b*.

The conveyor according to the invention also comprises means for adjusting the distance of the second portion 16*a* and 16*b* of the laminae 13*a* and 13*b* from the upper face of the corresponding ridge 3*a* and 3*b*.

More particularly, the flat strip 2*a* is fixed to a support 20 which is in turn mounted, so that it can be adjusted vertically, on a base 21.

The vertical adjustment of the support 20 with respect to the stand 21 can be achieved, in a per se known manner, by means of a knob 22 which can be actuated to adapt the height of the flat strips 2*a* and 2*b* with respect to the sewing unit served by the conveyor.

The flat strip 2*b* is instead supported by two blocks 23 and 24 which are in turn supported by means of a pair of horizontal guides 25 and 26 which are connected to the support 20 and lie at right angles to the passage 4.

The distance of the flat strip 2*b* from the flat strip 2*a*, and therefore the width of the passage 4, can be adjusted by moving the blocks 23 and 24, in a manner which is per se known and is not shown for the sake of simplicity, along the guides 25 and 26. It should be noted that the movement of the block 23 along the corresponding guide 25 can be differentiated, according to the requirements, with respect to the movement imparted to the block 24 along the guide 26, so as to achieve, when required, a gradual increase or decrease in the width of the passage 4 along the advancement direction 5 of the hose 51.

The sprockets 11*a*, 11*b*, 12*a* and 12*b* that support the chains 10*a* and 10*b* are supported, so that they can rotate about their respective axes, by a block 27 which is fixed to the end of posts 28*a* and 28*b* which are slidingly coupled to vertical seats 29*a* and 29*b* formed in the support 20.

The posts 28*a* and 28*b* are conveniently partially hollow, and between the bottom of the seats 29*a* and 29*b* and the posts 28*a* and 28*b* there are interposed springs 30*a* and 30*b* which elastically contrast the lowering of the block 27 with respect to the support 20.

The vertical adjustment of the position of the block 27 with respect to the support 20 is achieved by means of a knob 31 which is supported by the base 21 through a plate 32 and has a threaded shaft 33 which engages a female thread 34 which has a vertical axis and is formed in the block 27. In practice, the rotation of the knob 31 produces the upward or downward movement of the block 27 with respect to the support 20.

Instead of the knob 31, it is possible to use a step motor which is mounted on the plate 32 and is connected to the threaded shaft 33 by means of its output shaft.

The same means for the vertical adjustment of the block 27 and therefore of the chains 10*a* and 10*b* are used to vary the distance of the laminae 13*a* and 13*b* from the corresponding ridges 3*a* and 3*b*.

More particularly, each lamina 13*a* and 13*b* is fixed to two bushes 40*a* and 40*b*, the axes whereof being perpendicular to the plane of arrangement of the flat strips 2*a* and 2*b*; a pin 41*a* and 41*b* is slidingly inserted in said bushes, is fixed to the corresponding flat strip 2*a* and 2*b* and protrudes upwards therefrom.

The upper base of the bushes 40*a* and 40*b* is closed, and between said base and the upper end of the corresponding pin 41*a* and 41*b* there is an interposed spring 42*a* and 42*b* which elastically contrasts the movement of the lamina 13*a* and 13*b* toward the corresponding ridge 3*a* and 3*b*.

The block 27 rests on the bushes 40*a* and 40*b* of the laminae 13*a* and 13*b* and thus, by adjusting the vertical position of the block 27 by means of the knob 31, the distance of the laminae 13*a* and 13*b* from the corresponding ridge 3*a* and 3*b* is adjusted automatically.

The bushes 40*a* and 40*b* are fixed to the corresponding lamina 13*a* and 13*b* at the second portion 16*a* and 16*b*, which is conveniently wider than the initial portion 15*a* and 15*b* and wider than the third portion 17*a* and 17*b*.

The initial portion 15*a* and 15*b* of each lamina has a slot 45*a* and 45*b* which is elongated in a direction which is parallel to the advancement direction 5 and slidingly couples to a corresponding pin 46*a* and 46*b* which protrudes from the upper face of the first portion 6*a* and 6*b* of the corresponding ridge 3*a* and 3*b*, so as to keep the initial portion of the lamina 13*a* and 13*b* correctly positioned with respect to the flat strip 2*a* and 2*b*, also allowing the lamina 13*a* and 13*b* to slide with respect to the corresponding flat strip 2*a* and 2*b* as a consequence of the change in the distance of the lamina 13*a* and 13*b* from the corresponding ridge 3*a* and 3*b*.

For the sake of completeness in description, it should be noted that the sprocket 12*a* can be rotated about its own axis by means of a motor or other adapted actuation element by means of a chain-type linkage 48 and is connected to the sprocket 12*b* by means of a pair of gears 49*a* and 49*b*.

The operation of the conveyor according to the invention is as follows.

The hose 51, which is prepared with a portion 50, proximate to the tip to be sewn, which is thinner than the border 52 with which the hose is ended and thinner than the remaining part of the hose, is inserted between the flat strips 2*a* and 2*b* so that the portion 51 is arranged at the ridges 3*a* and 3*b*, i.e., so that the border 52 protrudes upwards and the remaining part of the hose protrudes downwards from the ridges 3*a* and 3*b*.

The hose 51 is then moved by the operator along the passage 4 until it is at the beginning of the chains 10*a* and 10*b*.

During this advancement, the border 52 rests on the initial portion 15*a* and 15*b* and then on the second portion 16*a* and 16*b* of the laminae 13*a* and 13*b*.

The laminae 13*a* and 13*b* then tension the hose upwards so as to keep the border 52 positioned correctly, particularly as regards its initial part, allowing it to be gripped correctly by the chains 10*a* and 10*b*. The upward tensioning performed by the laminae 13*a* and 13*b* also allows to correctly position the lower border of the portion 50 of the hose 51, i.e., the beginning of the actual hose, at which the seam for closing the tip will be formed, on the lower face of the ridges 3*a* and 3*b* regardless of the height of said portion 50. In this manner, the conveyor according to the invention can be used for hoses in which the thinner portion 51 has different heights without requiring replacement of the flat strips 2*a* and 2*b*.

It should be noted that the degree of tension applied by the laminae 13*a* and 13*b* to the hose can be changed by acting on the knob 31. The change in the distance between the laminae 13*a* and 13*b* and the corresponding ridges 3*a* and 3*b* automatically also varies the position of the chains 10*a* and 10*b*, in any case ensuring the correct grip of the border 52 by the chains 10*a* and 10*b*.

In practice, it has been observed that the conveyor according to the invention fully achieves the intended aim, since it allows to provide correct positioning, with respect to the sewing unit, and thus achieve high-quality tip closure, of hoses prepared with thinner portions having different heights without requiring flat strip replacement.

The conveyor thus conceived is susceptible of numerous modifications and variations, all of which are within the scope of the inventive concept; all the details may furthermore be replaced with other technically equivalent elements.

In practice, the materials used, as well as the dimensions, may be any according to the requirements and the state of the art.

What is claimed is:

1. A conveyor for sewing machines for closing the tip of hoses, comprising a pair of substantially co-planar flat strips which are laterally adjacent to each other and have, on their mutually facing sides, a pair of protruding ridges which laterally delimit a passage for a portion of the hose, proximate to the tip, which is knitted with a reduced thickness with respect to the contiguous regions; each one of said ridges having, along the advancement direction of the hose along said passage, an initial portion and a final portion which are substantially parallel, are mutually spaced and are joined by an inclined intermediate portion, means for advancing the hose along said passage being provided above said flat strips at said passage; the conveyor further comprising, arranged above each one of said ridges, starting from a region of said initial portion, a lamina which forms a resting surface for the upper border of said thinner portion of the hose, each said lamina being supported in the conveyor so as to be adjustably movable with respect to the corresponding ridge towards or away from the corresponding ridge such that the position of each said lamina with respect to the corresponding ridge is adjustable.

2. A conveyor according to claim 1, wherein said lamina can flex elastically towards or away from the corresponding ridge.

3. A conveyor according to claim 1, wherein said flat strips are arranged on a substantially horizontal plane.

4. A conveyor according to claim 1, wherein said lamina has an initial portion which is inclined upwards starting from the upper face of the initial portion of the corresponding ridge.

5. A conveyor according to claim 1, wherein said lamina has, downstream of said initial portion, along the advancement direction of the hose along said passage, a second portion which is substantially parallel to said initial portion of the corresponding ridge.

6. A conveyor according to claim 5, wherein the region where said hose advancement means act begins at said second portion of the lamina.

7. A conveyor according to claim 5, further comprising means for adjusting the distance of said second portion of the lamina from the upper face of the corresponding ridge.

8. A conveyor according to claim 5, wherein elastic means are interposed between said lamina and the corresponding ridge and contrast the movement of said lamina toward the corresponding ridge.

9. A conveyor according to claim 1, wherein said advancement means comprise a pair of chains which mesh with sprockets which are arranged so that their axes are substantially perpendicular to the plane of arrangement of said flat strips, said chains having two portions which face each other above said flat strips at said passage in order to engage the portion of the hose that protrudes upward from said flat strips.

10. A conveyor according to claim 9, further comprising means for adjusting the distance of said pair of chains from the upper face of said flat strips.

11. A conveyor according to claim 9, wherein said sprockets are supported by a block which can move on command with respect to said flat strips in a direction which is substantially perpendicular to the plane of arrangement of said flat strips.

12. A conveyor according to claim 11, wherein said block rests on said laminae.

13. A conveyor according to claim 5, wherein said lamina has, downstream of said second portion along the advancement direction of the hose along said passage, a third portion which lies above said intermediate portion of the corresponding ridge.

14. A conveyor according to claim 5, wherein said lamina has, downstream of said second portion along the advancement direction of the hose along said passage, a third portion which lies above said intermediate portion and said second portion of the corresponding ridge.

15. A conveyor according to claim 8, wherein said lamina is supported, with said elastic means interposed, by the corresponding flat strip at said second portion of the lamina.

16. A conveyor according to claim 1, wherein said lamina is fixed to bushes which are arranged so that their axes are perpendicular to the plane of arrangement of said flat strips and can slide on pins which are fixed to the upper face of said flat strips, springs being interposed between said pins and the corresponding bushes and elastically contrasting the movement of said lamina toward the corresponding ridge.

17. A conveyor for sewing machines for closing the tip of hoses, comprising a pair of substantially co-planar flat strips which are laterally adjacent to each other and have, on their mutually facing sides, a pair of protruding ridges which laterally delimit a passage for a portion of the hose, proximate to the tip, which is knitted with a reduced thickness with respect to the contiguous regions; each one of said ridges having, along the advancement direction of the hose along said passage, an initial portion and a final portion which are substantially parallel, are mutually spaced and are joined by an inclined intermediate portion, means for advancing the hose along said passage being provided above said flat strips at said passage; the conveyor further comprising, arranged above each one of said ridges, starting from a region of said initial portion, a lamina which forms a resting surface for the upper border of said thinner portion of the hose, and supporting means for supporting each said lamina in the conveyor such that each said lamina is adjustably movable with respect to the corresponding ridge towards or away from the corresponding ridge such that the position of each said lamina with respect to the corresponding ridge is adjustable, and the conveyor further comprising adjustment means acting on said supporting means for automatically adjusting the position of each said lamina with respect to the corresponding ridge.

18. A conveyor for sewing machines for closing the tip of hoses, comprising a pair of substantially co-planar flat strips which are laterally adjacent to each other and have, on their mutually facing sides, a pair of protruding ridges which laterally delimit a passage for a portion of the hose, proximate to the tip, which is knitted with a reduced thickness with respect to the contiguous regions; each one of said ridges having, along the advancement direction of the hose along said passage, an initial portion and a final portion which are substantially parallel, are mutually spaced and are joined by an inclined intermediate portion, a device for advancing the hose along said passage being provided above said flat strips at said passage; the conveyor further comprising, arranged above each one of said ridges, starting from a region of said initial portion, a lamina which forms a resting surface for the upper border of said thinner portion of the hose, and a supporting device for supporting each said lamina in the conveyor such that each said lamina is adjustably movable with respect to the corresponding ridge towards or away from the corresponding ridge such that the position of each said lamina with respect to the corresponding ridge is adjustable, and the conveyor further comprising an adjustnent device acting on said supporting device for automatically adjusting the position of each said lamina with respect to the corresponding ridge.

* * * * *